US008863336B2

(12) United States Patent
Theosabrata

(10) Patent No.: US 8,863,336 B2
(45) Date of Patent: Oct. 21, 2014

(54) MATTRESS AND BEDDING SYSTEM

(76) Inventor: Yos Soetanto Theosabrata, Jakarta (ID)

( * ) Notice: Subject to any disclaimer, the term of this patent is extended or adjusted under 35 U.S.C. 154(b) by 476 days.

(21) Appl. No.: 13/039,664

(22) Filed: Mar. 3, 2011

(65) Prior Publication Data

US 2011/0271447 A1 Nov. 10, 2011

(30) Foreign Application Priority Data

May 4, 2010 (EP) ..... 10161834

(51) Int. Cl.
*A47C 27/08* (2006.01)
*A47C 27/20* (2006.01)
*A47C 19/02* (2006.01)

(52) U.S. Cl.
CPC ..... *A47C 27/082* (2013.01); *A47C 19/025* (2013.01); *Y10S 5/936* (2013.01)
USPC ..... 5/652.1; 5/654; 5/655.3; 5/655.5; 5/655.9; 5/706; 5/710; 5/936

(58) Field of Classification Search
USPC ..... 5/652.1, 652.2, 654, 654.1, 655.3, 693, 5/706, 710, 713, 724, 936; 267/64.24, 267/64.27
See application file for complete search history.

(56) References Cited

U.S. PATENT DOCUMENTS 3,255,470 A * 6/1966 Knittel et al. ..... 267/117
3,263,247 A * 8/1966 Knittel et al. ..... 267/117
3,605,145 A * 9/1971 Graebe ..... 5/706
3,784,994 A * 1/1974 Kery ..... 5/710
4,194,255 A * 3/1980 Poppe ..... 267/153
4,827,546 A * 5/1989 Cvetkovic ..... 5/665
4,895,352 A * 1/1990 Stumpf ..... 267/80
4,951,336 A * 8/1990 Silverman ..... 5/653
4,982,466 A * 1/1991 Higgins et al. ..... 5/713
5,161,272 A * 11/1992 Yamaguchi et al. ..... 5/693
5,265,293 A * 11/1993 Spahn et al. ..... 5/706
5,584,084 A 12/1996 Klearman et al.
5,836,027 A * 11/1998 Leventhal et al. ..... 5/706
5,907,878 A * 6/1999 Thomas et al. ..... 5/710
6,026,527 A * 2/2000 Pearce ..... 5/654
6,212,720 B1 4/2001 Antinori et al.
6,560,803 B2 5/2003 Zur
6,598,251 B2 7/2003 Habboub et al.
6,701,556 B2 3/2004 Romano et al.
6,739,009 B2 * 5/2004 del Drago ..... 5/713
6,745,420 B2 6/2004 Giori et al.
7,386,903 B2 6/2008 Hochschild
7,571,504 B2 * 8/2009 Kuo ..... 5/724
2005/0177952 A1 8/2005 Wilkinson et al.
2008/0028533 A1 * 2/2008 Stacy et al. ..... 5/713
2010/0218318 A1 * 9/2010 Steppat et al. ..... 5/690

* cited by examiner

*Primary Examiner* — William Kelleher
*Assistant Examiner* — David R Hare
(74) *Attorney, Agent, or Firm* — Keusey & Associates, P.C.

(57) ABSTRACT

The invention provides a mattress comprising an array of air springs, each in communication with a supply of air for selectively varying the air pressure within said spring, so as to provide a resilient body against which a user may recline; an aperture in an upper surface of each air spring, providing access to a cavity within said spring, said cavity open to ambient pressure and sealed from the air supply.

7 Claims, 11 Drawing Sheets

MATTRESS AND BEDDING SYSTEM

BACKGROUND OF THE INVENTION

1. Field of the Invention

The invention relates to systems and assemblies for bedding structures including mattress arrangement and bed frame structures in which to encase said mattresses.

2. The Prior Art

Key determinants for the function of a mattress include comfort, aesthetics, and stability. Furthermore these determinants are measured not on an initial basis, but over an extended period of years of use.

Traditional forms of mattresses, including sleeping mats filled with natural materials, were subsequently replaced by more comfortable resilient materials used, such as polyurethane foam, foam latex, air and even water, in order to provide a homogeneous material which will provide long time stability and comfort to the user.

The difficulty with these homogeneous materials is the lack of resilient behavior, with these materials tending to absorb the load and so sacrificing comfort for long term stability. In any event, the polymer materials, such as latex and polyurethane, still lack long term effectiveness as the material is eventually broken down, to deform into set shapes, such as the user's body shape, or flattening down and otherwise diminishing in comfort.

Whilst involving a higher degree of assembly, alternative construction using springs represents the higher end of the mattress market. This premium is due to the cumulative benefits of distributing load to the individual spring units, which provides greater resilience and prevents deformed shapes. The springs, therefore, provide a mattress with longer term comfort and stability.

The drawback of a spring mattress, however, is its load carrying capacity. Because the springs are of metal construction, if a user is too heavy, the springs in the preferred sleeping position will eventually fatigue and deform. Alternatively, if a bed having stiffer springs is used and the user is underweight, the mattress will lack comfort through being too hard. Thus, conventional spring construction requires a balance between the stiffness of the springs and the weight of the user.

A mattress having multiple foam layers instead of springs is shown in U.S. Pat. No. 6,701,556. The patent places above foam base 10, 50, one or more indented fiber layers or other such three dimensional engineered material layers having a plurality of resilient members 76 over the base 10, 50. Such engineered materials may include three dimensioned fiber layer networks made from textile fibers that have projections and optional depressions, or other such structures, for example, spring or spring-like protrusions may be used. Typically, two to four such layers 60 are provided as illustrated in FIGS. 2 and 2A. The foam base 10, 50 and the plurality of layers 60 are then encased in a cover 62 as shown in FIG. 2.

Further, encapsulating the mattress will typically be some form of structure to retain the mattress in place. The function of such a structure will vary widely and include aesthetics, the ability to retain the mattress in a single location, a support for bedroom furniture and other such uses.

A mattress having an air/foam mattress matrix assembly is described in U.S. Pat. No. 5,836,027. The mattress includes an air mattress with a plurality of compressible and expandable members extending upwardly from the base. The expandable members have a cylindrical shape with a flat top that can be adjusted vertically by increasing the pressure therein. The expandable members are contained within a foam restraining member. However, the mattress does not include a bed frame to contain the mattress.

The side walls used to construct the bed frame structure are typically wooden and sometimes coated in a polyurethane foam. Given the desired longevity of the mattress, the structure encapsulating the mattress is expected to maintain its structural and aesthetic function for at least as long.

However, typical construction of the bed frame structure will exhibit damage through wear and tear. Further, it is susceptible to damage from insect infestation, such as termites and borers, not to mention warping of the side walls, particularly in humid conditions. Thus, the longevity of the bed frame structure is often diminished functionally and frequently diminished aesthetically.

SUMMARY OF THE INVENTION

It is therefore an object of the present invention to provide air springs with increased comfort.

It is another object to create a cavity within the air springs to hold an insert of various types to enhance the sleeping experience.

It is a further object to provide a frame which supports the air mattress and is easily manufactured from a polymer material.

It is yet another object to provide a vibration free support for a compressor that is suspended from the frame platform.

Therefore, in a first aspect of the present invention, the use of air springs achieves the benefit of conventional metal springs through providing an array of support to the user. However, unlike metal springs, the use of air as the supporting material does not suffer fatigue or defamation and so the long term benefit is enhanced. Further, the addition of a cavity in the spring provides further resilient behavior under load from the individual spring and may further provide advantage in adding extrinsic material to the spring, such as perfume, magnets, anti-bacterial material, etc., without affecting performance.

In one embodiment, the cavity may be used to support a soft material such as foam, rubber, or polyurethane foam to add further comfort to the user.

By providing this cavity, the mattress construction is not limited on the quantity or size of the materials placed in the cavity, as would be the case were the cavity not present.

The mattress may include an airbag in communication with the underside of the air spring in order to selectively apply pressure to one or more groups of air springs via a compressor. Accordingly, a system according to the present embodiment may provide better stability and reduce shock impulses arising from a change of position of the user during sleep.

With regard to the second aspect, reinforcing the side wall members of the bed frame structure may allow extra materials to be used purely for aesthetic purposes, with the metal reinforcement acting as the major structural component of the bed frame structure. In one embodiment, the side walls of the bed frame structure may include an outer polymer layer. In a further embodiment, the polymer layer may be a relatively soft and resilient material, for instance, polyurethane, foam latex.

In a further embodiment, the inter connector located between adjacent side walls may be connectable to the metal reinforcement within each side wall.

In a further aspect, the bed frame structure may be constructed according to the method of preparing supporting frame work for the side walls; arranging the supporting framework using a bracket; installing the connector to each adjacent side wall at said corner; arranging the frame work at 90 degrees at each corner; and bolting the inter connector so as to fix the side walls in place.

In a further embodiment, the side walls may be integrally formed about the steel reinforcement. For instance, the side walls may be molded so as to encapsulate the steel reinforcement. Said metal reinforcement may include projections or other elements to facilitate bonding with the molded material to form the side wall. Still further, the metal reinforcement may include members projecting from the side wall following the encapsulating process, so as to facilitate connection with the interconnecting members. Thus, the encapsulation may not be a complete encapsulation, but instead sufficient to allow projections at distal ends of said side walls.

It will be noted that through a bolted connection with the inter connector, the bed frame structure may be assembled and disassembled for transport and storage.

In a further embodiment, the bed frame structure may include a platform mounted within the assembled side walls for supporting a mattress to be placed thereon. In a further embodiment, the platform may provide stability for the assembled side walls, so as to maintain shape.

In a further embodiment, the side walls may include projections or recesses, such that placement of the platform fits onto said projections or into said recesses to form an interconnected assembly.

In a further embodiment, the cavity may be arranged to receive an insert of a material softer than the air spring, the cumulative effect of said inserts within the array of air springs increasing the relative softness of the mattress.

The air springs may be connected to an air supply and valve arrangement. If the user wishes more support, more air can be added by opening the valve; and if less support, then air can be vented. This threshold pressure will depend on the design of the mattress, including thickness of the air spring material, number of air springs, etc.

The bed frame structure further includes an array of air springs and an air bladder in communication with said array of air springs for providing varying levels of air pressure to said array of air springs. A foam layer having a plurality of through cut-outs is in registration with said air springs. The array of air springs are disposed within said frame, with said foam layer being placed on top of said array with each air spring occupying a corresponding through cut-out. Each air spring includes an outer cylindrical surface formed with accordion folds, wherein said accordion folds, said foam layer and said side wall members collectively restrict the air springs from outward radial expansion when subject to increased internal pressure.

The mattress assembly further includes a foam bullet disposed within the aperture of the air springs. The foam layer comprises a first fixed density component, with said air spring comprising a variable density component. The foam bullet comprises a second fixed density component completely encircled by said variable density component; wherein the first, second and third density components all reside within the same plane.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views.

DETAILED DESCRIPTION OF THE PREFERRED EMBODIMENTS

Figure 1A:
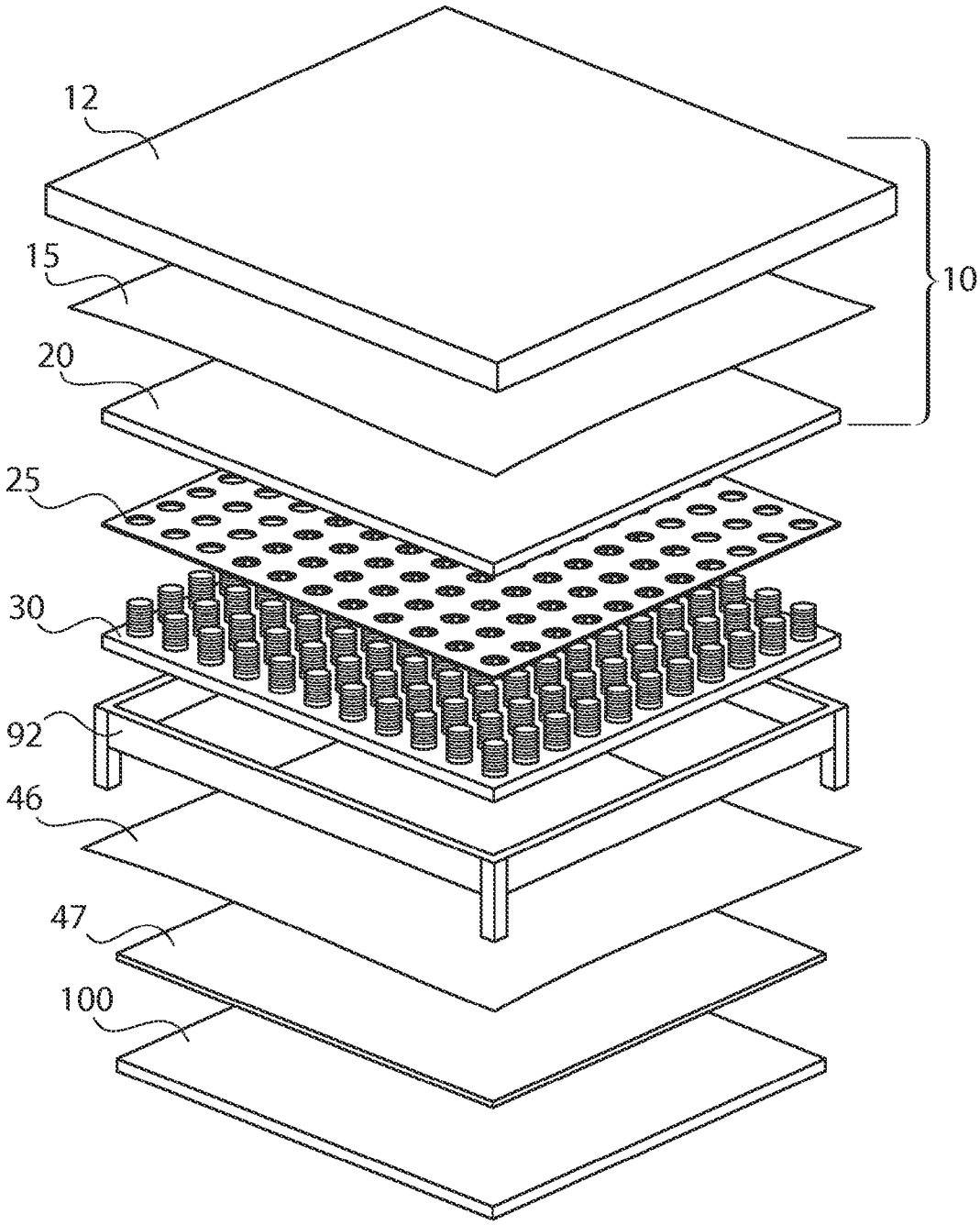
FIG. 1A is an exploded isometric view of a mattress assembly according to one embodiment of the present invention.
Figure 1B:
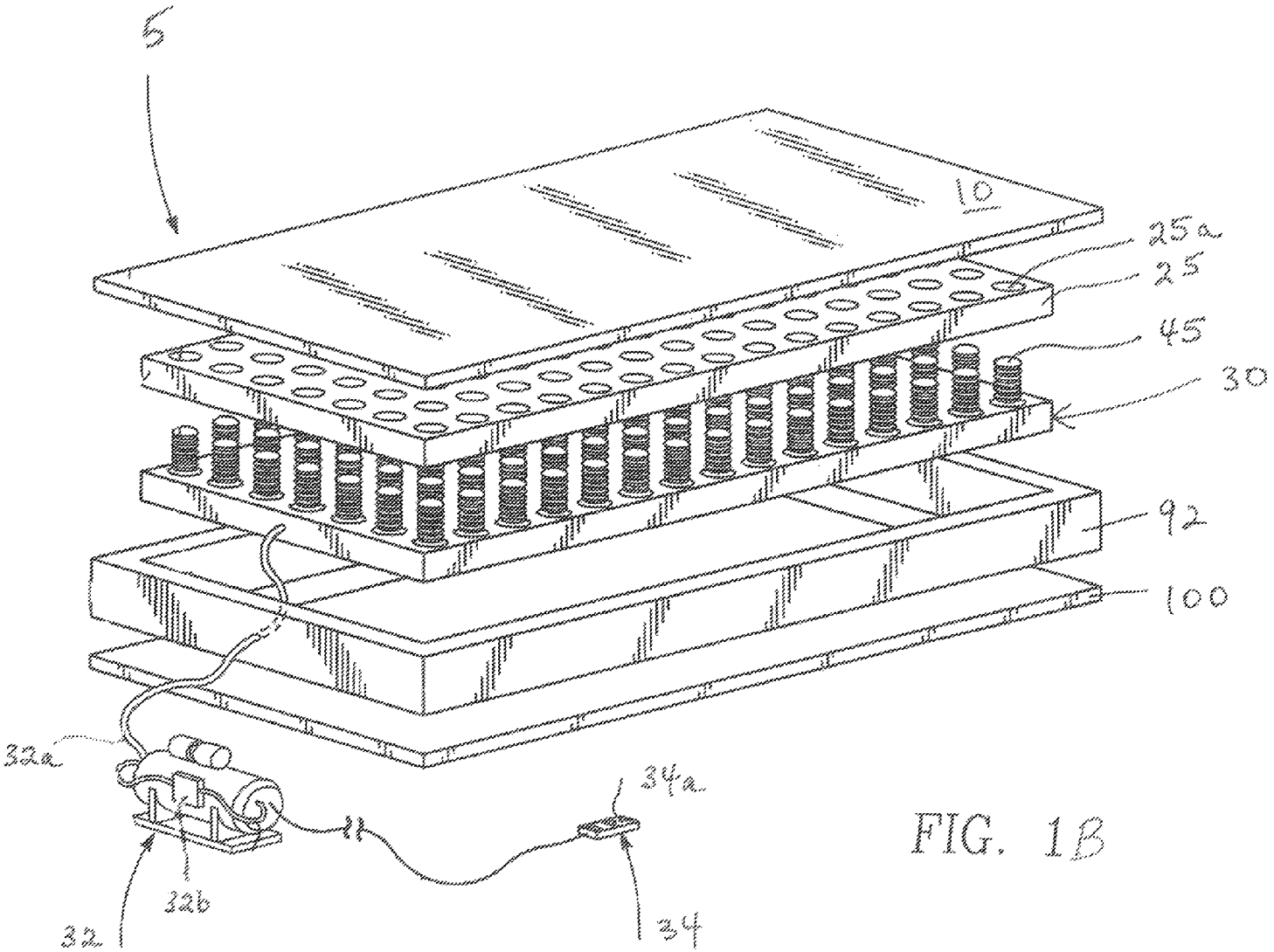
FIG. 1B is a further exploded isometric view showing the components with respect to the frame.

Referring now in detail to the drawings, FIGS. 1A and 1B shows the mattress assembly 5 according to one aspect of the present invention. The components of FIG. 1A will be described from the top layer down. Here the exploded view of the mattress assembly shows an upper mattress portion 10. In one embodiment, the upper mattress portion includes three layers including an upper cover 12 with a latex layer 15 directly beneath it. The third and lowest layer may be a polyurethane foam layer 20.

Upper cover 12 may be made from a natural or synthetic fabric. In a practical embodiment, the cover was made from a fabric containing 0.14% intense polyamide, 4% polyamide, 80% polyester and 16% viscose. The fabric had a weight of 340 grams/$m^2$. The fabric contained finishing comprising silver which functions as an antimicrobial treatment. The process involves reducing metallic silver to ultra-fine particles which are attached to the textile fibers. An example of a commercially available product is Silpure®, which is a Registered trademark of Thomson Research Associates of Toronto, Canada.

Layer 15, which is referred to as a "latex" layer for the purposes of identification, may be made from natural latex, heat sensitive foam, memory foam or polyurethane foam. In a practical embodiment, layer 15 and layer 20 were made from a polyurethane foam having a density in the range from about 22 to about 70 kg/$m^3$. Layer 15 could alternatively be made from memory foam, heat sensitive foam or natural latex having a density in the range from about 75 to about 80 kg/$m^3$.

Next is an ethylene-vinyl acetate (EVA) foam layer 25 having a plurality of apertures 25*a* arranged therein. The EVA foam layer 25 overlies an air bladder 30 having a plurality of air springs 45. The air springs 45 and apertures 25*a* are disposed in registration with each other so that the air springs will extend up into the apertures 25*a* when the EVA foam layer 25 is placed onto air bladder 30. The above described components are mounted within a bed frame structure 92 and supported by a platform 100. Platform 100 may be provided with a cushion layer, for example a lower foam layer 47 enclosed within a lower cover 46. Lower foam layer 47 may be the same material as foam layer 20. Lower cover 46 may be the same material as upper cover 12.

The EVA foam layer 25 may have a density in a range of about 40 to about 70 kg/m$^3$. In comparison to layer 15 with the 22-70 kg/m$^3$ density, the density of the EVA 25 to layer 15 may be in a ratio (EVA 25:layer 15) from about 3.2:1 through 1:1.75. In comparison to layer 15 with the 75-80 kg/m$^3$ density, the density of the EVA to layer 15 may be in a ratio (EVA 25:layer 15) from about 1:1 through 1:2. In comparison to layer 20, the density of the EVA to layer 20 may be in a ratio (EVA 25:layer 20) from about 3.2:1 through 1:1.75.

As will be described more fully below, EVA layer 25 functions to contain air springs 45 and to provide support for the spaces in between the air springs. A suitable material for layer 25 will possess the following material properties. A Tensile Strength within a range of about 450 to about 800 kPa, according to ASTM D 412-87, Die A. The Tensile Strength can be nominally 600 kPa. A Tear Strength within a range of about 2.5 to about 4.5 kN/m, according to ASTM D 624-86, Die C. The Tear Strength can be nominally 3.5 kN/m. An Elongation at Break of 200-250% or 250-300%, according to ASTM D 412-87, Die A. A Compressive Strength in the range of about 30 to about 90 kPa, according to ASTM D 3575-91, Suffix D. The Compressive Strength can be nominally 45 kPa.

A description of FIG. 1B will be provided from the bottom layer up. Bed frame structure 92 and platform 100 will be described in further detail below. Air bladder 30 communicates with air springs 45. Air bladder 30 may comprise a single chamber which communicates will all air springs 45. Alternatively, air bladder 30 may be divided into two or more chambers, each of which communicates with a selected group of air springs 45. For example, air bladder could be divided into a left, middle and right chamber, each of which communicates with approximately one-third of the air springs. Air bladder 30 and air springs 45 may be made from a soft and flexible plastic material, such as polyurethane (PU), polyvinyl chloride (PVC), a synthetic/natural rubber, a plastic, a rubberized plastic or a rubber/plastic blend. Generally, the air bladder and springs can be made from any suitable air impermeable material that allows the air springs to expand and contract vertically as the air pressure within the air bladder increases and decreases.

A single bed 30 typically has 150 or more air springs 45. The firmness of the entire bed is controlled through the air pressure that is delivered to the air bladder which then communicates to the air springs. The user can vary the pressure in the air bladder. The ability to vary the pressure, and consistently change between different pressure settings is a major advantage of the air mattress of the invention over mattresses of the prior art. A compressor 32 is connected to air bladder 31 via hose 32*a*. Compressor 32 is equipped with a pressure sensor 32*b*. A controller 34 is operatively connected to compressor 32 by either wired or wireless means. Controller 34 permits the user to operate compressor 32 to increase or decrease the pressure within air bladder 30. A pressure meter 34*a* may be provided on controller 34 so that the user can read pressure values.

Figure 2A:
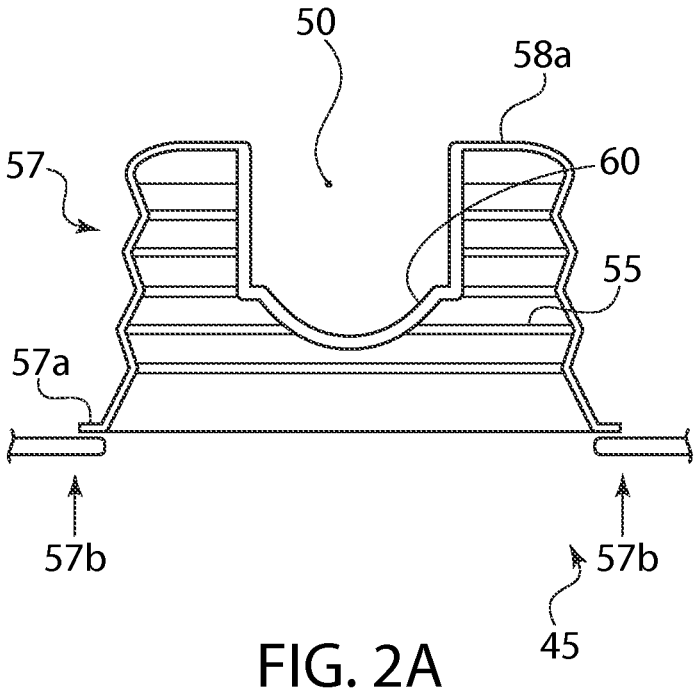
FIGS. 2A and 2B are sectional views of an air spring according to a further embodiment of the present invention.
Figure 2B:
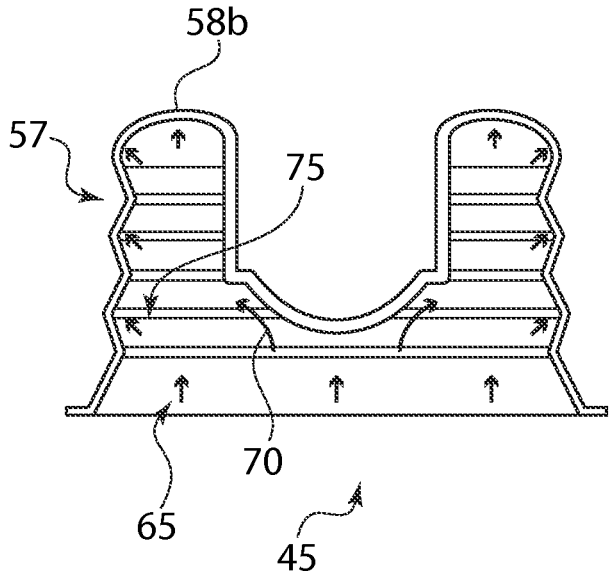

FIGS. 2A and 2B show a series of cross-sectional views of an air spring 45 according to one embodiment of the present invention. In cross-section the air spring has an M-shaped envelope which creates a U-shaped internal void 55. The pressurized air can be supplied from the compressor, through the air bladder into the envelopes of the air springs. The air spring includes an annulus 57 which surrounds and defines a cavity 50 in an upper portion of the air spring 45. In other words, the air spring 45 forms the shape of a cup, mug or a hollow cylindrical tube. At the base of the cavity is a concave bowl 60 which may be used to receive liquid or gel, such as perfume or other aromatic material. It should be noted that the cavity 50 may be shaped to receive a range of articles, including magnets or extra foam inserts, so as to change the nature of the mattress assembly. In the case of the foam inserts, the inserts may be softer than the air spring and so enhance the overall softness of the mattress as compared to the mattress without the inserts. A small amount of adhesive may be provided to secure the article within the cavity, for example, double-sided tape or Velcro.

The outer lower edge of cylinder 57 terminates in a skirt 57*a* which forms a flat ring. The air bladder 30 may be manufactured in a manner similar to conventional air mattresses for sleeping or outdoor recreational applications. The top surface of air bladder 30 has a series of holes cut therein, for example by a cutting die. An air spring 45 is placed over each hole, with skirt 57*a* ultrasonically welded to the air bladder. The weld line 57*b* is formed as a complete circle to seal internal void 55 to the interior of air bladder 30. Within the internal void of 55 of the air spring 45, air pressure 65 may be selectively introduced into the air spring, which may bear 70 upon the underside of the bowl 60 and may bear 75 on the external walls of annulus 57.

In a practical embodiment, air bladder 30 has been constructed from polyvinyl chloride (PVC) having an elasticity of 55 phr. Other suitable materials may be used which have an elasticity within a range of about 45 to about 65 phr.

The accordion folds along the side of hollow cylinder 57 may be molded at various angulations representing differing degrees of folding. The angulations will allow air spring 45 to maintain a partially expanded configuration, even at low or no internal pressure. The accordion folds thereby provide a degree of pre-load in relation to the fully-expanded height of annulus 57. The accordion folds are then expanded as a function of pressure within internal void 55. As will be understood by those skilled in the art, the density and thickness of material used will also contribute to the degree of pre-load. In a practical embodiment, air springs 45 have been constructed from polyvinyl chloride (PVC), for example PVC 120A which is 90% transparent. The PVC may be dyed with a coloring agent in an amount of about 0.5% by weight, for example Blue P 6283

FIG. 2A illustrates air spring 45 inflated to a moderate pressure level. Depending on their construction, the accordion folds may be slightly expanded from their resting state. A top flat surface 58*a* is shown at the upper side of air spring 45. In this configuration, top flat surface 58*a* may be generally in the same plane as the upper surface of EVA foam layer 25 and the lower layer of upper mattress portion 10. At lower pressure levels, top flat surface 58*a* may reside below the plane of EVA foam layer 25 or below the plane of the lower layer of upper mattress portion 10.

FIG. 2B illustrates hollow cylinder 57 inflated to a higher pressure level. The accordion folds would be slightly more expanded than in the illustration of FIG. 2A. The most apparent change is the top curved surface 58*b*. Mathematically, top curved surface 58*b* may be described as having a frusto-toroidol shape, i.e. the shape of the upper portion of a toroid. In this configuration, top curved surface 58*b* may be generally extending above the plane of the upper surface of EVA foam layer 25. The top curved surfaces collectively press upward on the lower surface of upper mattress portion 10. In other words, polyurethane foam layer 20 may experience slight upward pressure from one or more banks of air springs. As the pressure increases, the top surface 58*b* becomes more rounded, and the contact patch pressing upwardly against PU foam layer 20 decreases. Cumulatively, these circular contact patches provides slight separation between PU foam layer 20 and EVA foam layer 25, to simulate floating of upper mattress portion 10.

Figure 3C:
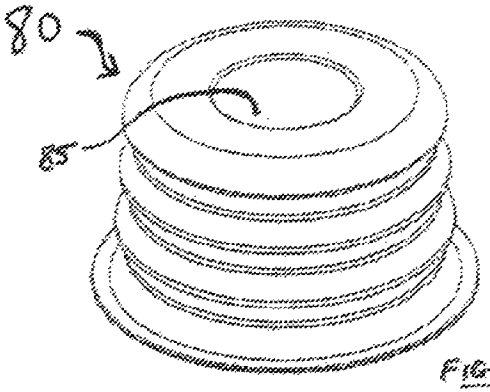
FIGS. 3A to 3D are various views of an air spring according to a further embodiment of the present invention.
Figure 3D:
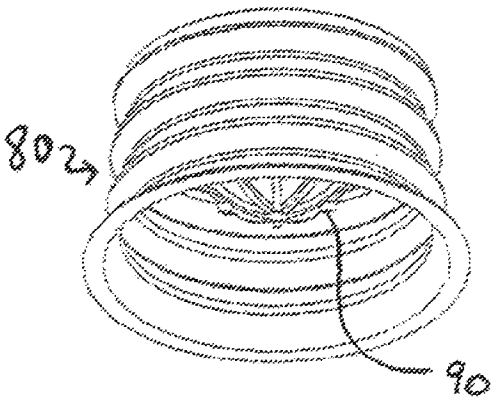
Figure 3A:
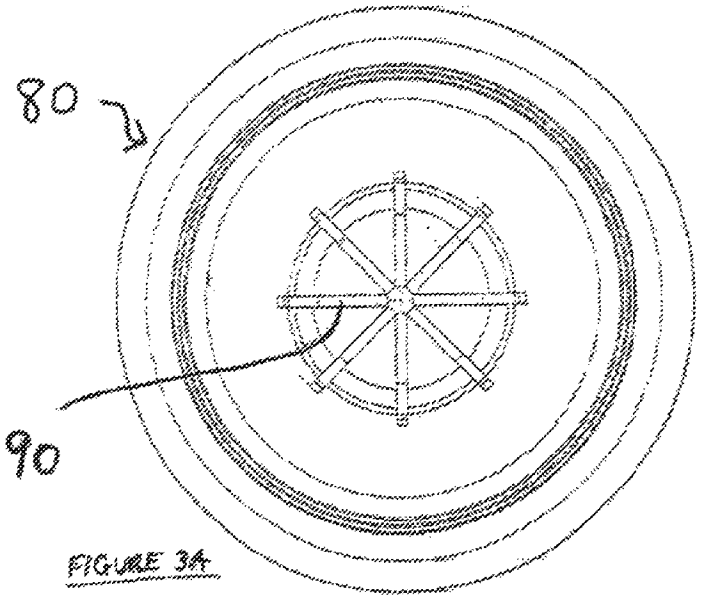
Figure 3B:
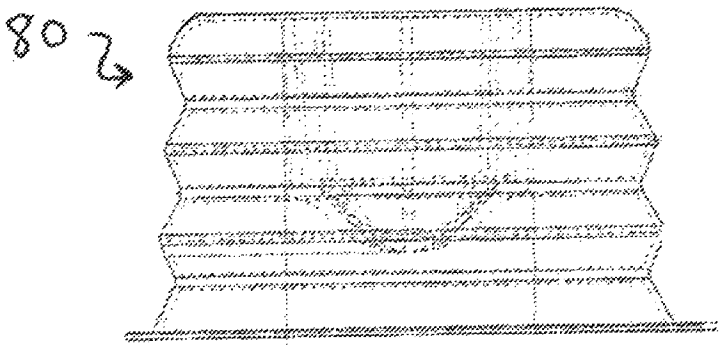

FIGS. 3A to 3D show various views of a further embodiment of the air springs according to the present invention. More particularly, FIG. 3A is a bottom plan view of air spring 80 and FIG. 3D is a bottom perspective view, both showing reinforcing ribs 90. Here an air spring 80 has a different structure from that of FIGS. 2A and 2B. FIG. 3B shows a side elevational view of air spring 80 with the internal structure of cavity 85 shown in dotted line. Functionally the two air springs 45, 80 will work in much the same way. FIG. 3C shows a perspective view of air spring 80. The air spring 80 of FIGS. 3A to 3D includes ribbing 90 to strengthen concave bowl 60 and so create a more rigid cavity 85.

Figure 4:
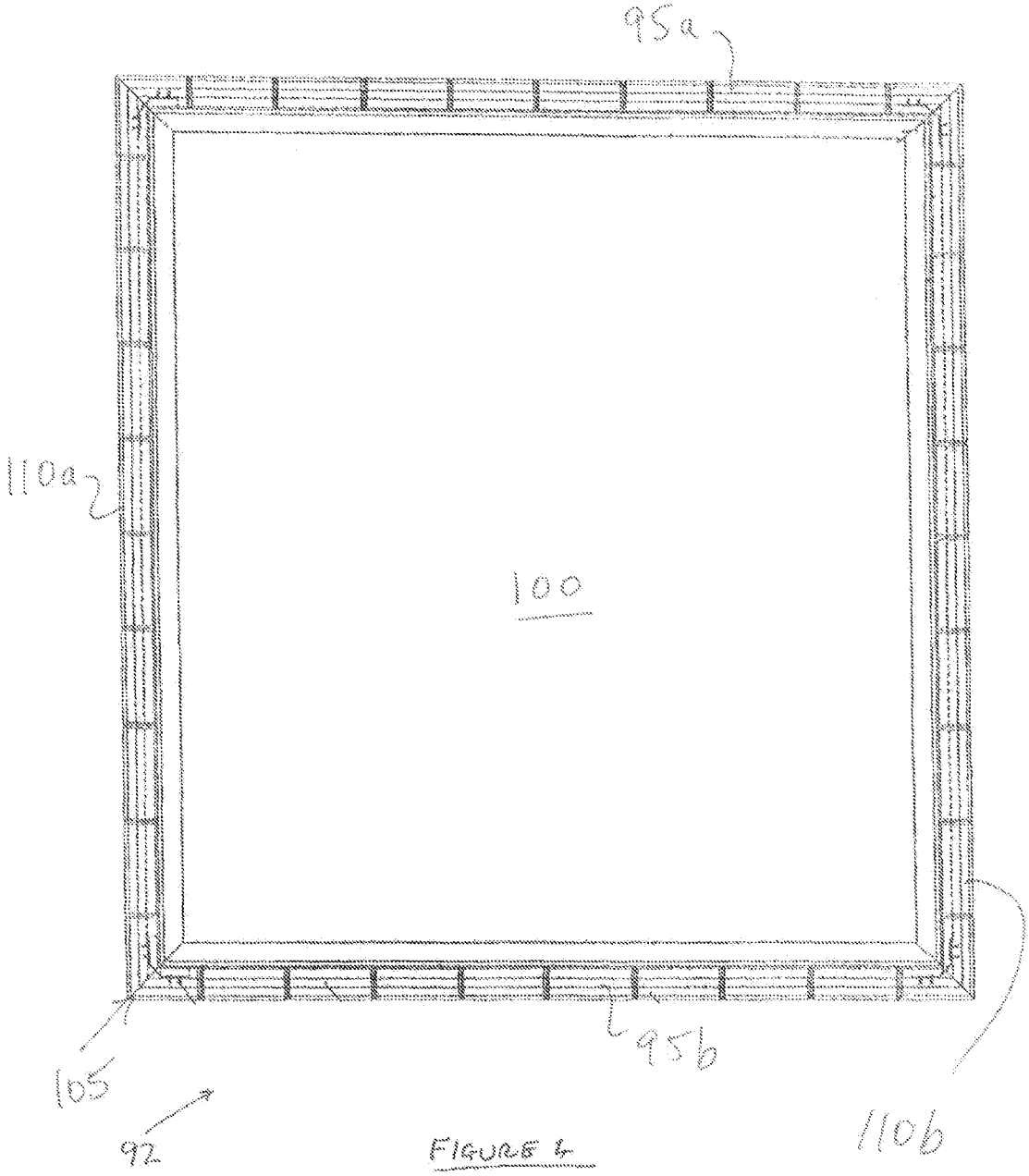
FIG. 4 is a plan view of a bed frame structure according to one embodiment of the present invention.
Figure 5:
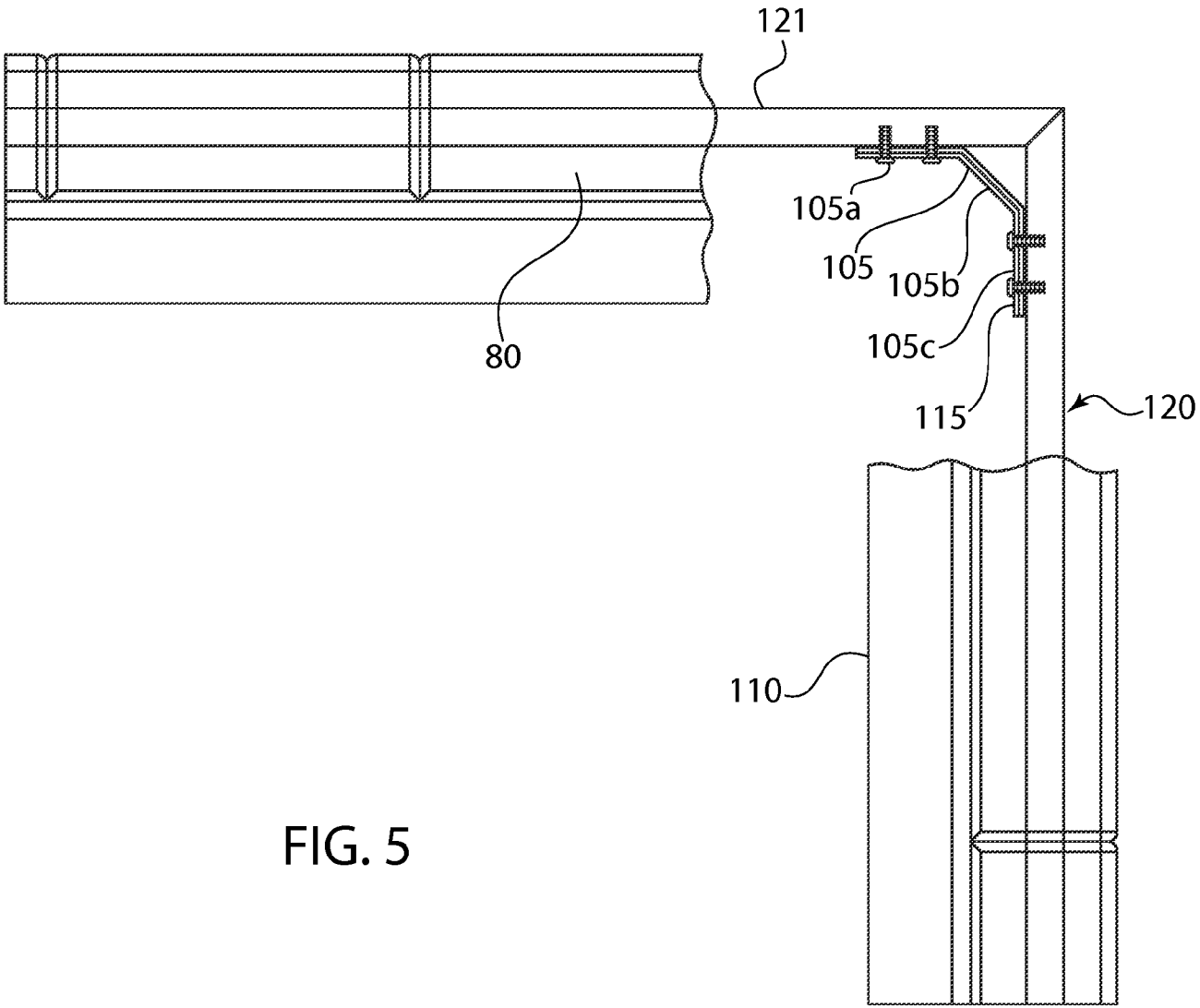
FIG. 5 is a detailed view of a corner assembly of the bed frame structure according to a further embodiment of the present invention.

FIG. 4 shows a plan view of the bed frame structure 92 according to one embodiment of the present invention. Here a platform 100 is supported within an assembly of top and bottom side frames 95*a* and 95*b*, and left and right side frames 110*a* and 110*b*, generally referred to as side frames 95, 110. The side frames are supported at each corner by an interconnecting member 105. FIG. 5 shows a detailed view of the corner assembly of the bed frame structure 92.

As can be seen in more detail in the partial cut-away view of FIG. 5, side frames 95, 100 are connected to together at each corner by an interconnecting member 105, which are securely coupled to reinforcing members 120, 121 which are parts of the side wall members 95, 110. The interconnecting member 105 may be screwed to members 120, 121, for example with wood screws, machine screws or sheet metal screws, however, the connection may be bolted or otherwise connected, to provide a removable connection. By providing a removable connection, the side walls can be separated from each other for ease of storage or moving. Reinforcing member 105 is configured as a connecting bracket, having, for example, a first side connection panel 105*a*, a central panel 105*b* set at 45 degrees to the first panel, and a second side connection panel 105*c* set at 45 degrees to the central panel. Each connection panel 105*a*, 105*c* may be provided with two or more non-threaded screw holes. Members 120, 121 are then provided with threaded screw holes. Machine screws will then pass through the screw holes and be threaded into members 120, 121. By appropriate tightening, the screw heads will apply a significant clamping force on panels 105*a*, 105*c* against members 120, 121.

Figure 6:
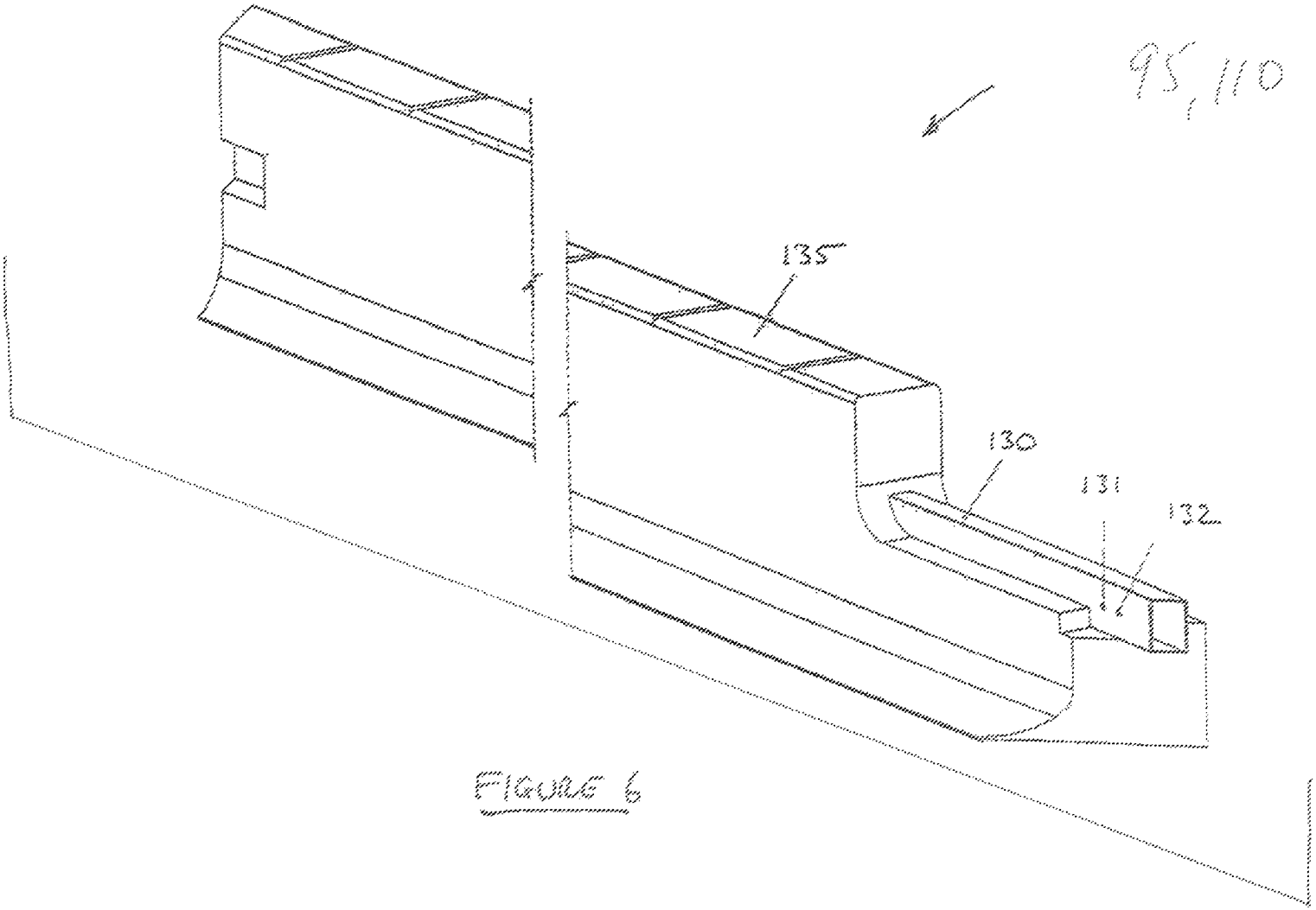
FIG. 6 is a sectional view of a side wall of a bed frame structure according to a further embodiment of the present invention.

FIG. 6 shows a partial cut away view of a side wall member 95, 110 where it can be shown a reinforcing member 130 is encapsulated by a material 135. In this case, the reinforcing member 130 is a metal rectangular hollow section, encased within a synthetic polymer molded member 135. In one embodiment, the polyurethane may be molded over a high-strength steel reinforcing member 130, so ensuring good contact between the reinforcing member 130 and the polyurethane 135. Reinforcing members 130 may be provided with slits or holes, into which the polymer can seep to increase its holding strength on the reinforcing members. From a manufacturing point of view, the reinforcing member is suspended in place within a mold. The foam is cast in place around the reinforcing member. End portions of the reinforcing member may extend outside of the mold to provide an exposed connecting end. Alternatively, a portion of the cast foam may be cut away to expose the connecting end of the reinforcing member.

In a practical embodiment, reinforcing members 130 have been constructed from steel tubes, for example square hollow bars having a width of about 20 mm and a height of 40 mm with a wall thickness of 1.2 mm. Polymer molded member 135 is formed from molded polyurethane foam.

Figure 7:
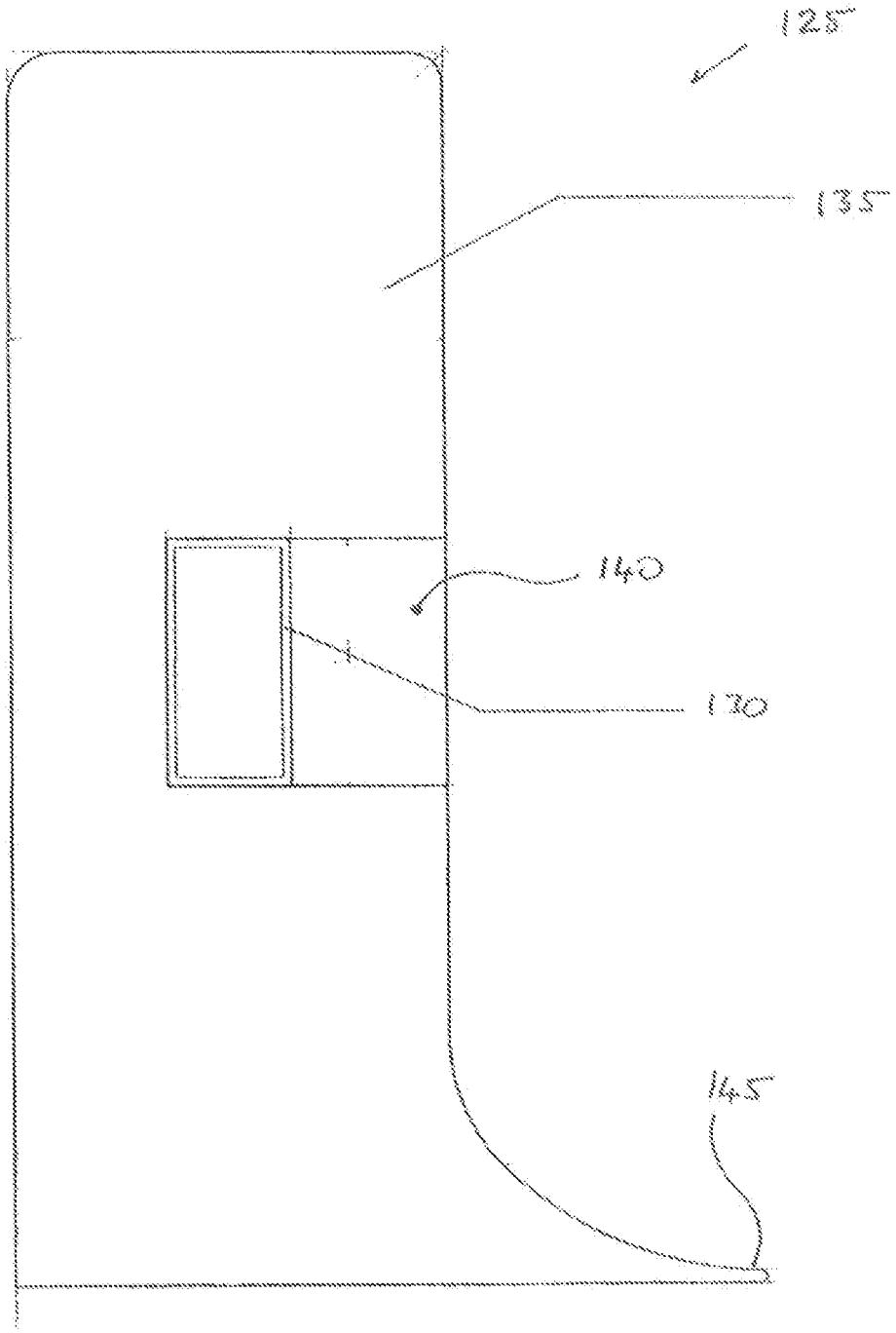
FIG. 7 is a sectional elevation view of the side wall of FIG. 6.

In an alternative embodiment, as shown in FIG. 7, the reinforcing member 130 may fit within a channel 140 of members 135. Thus, the side wall member 125 may comprise an assembly of a pre-molded polyurethane member 135 into which the rectangle hollow section 130 is fit later. Member 135 may be formed by injection molding, extrusion or other suitable industrial process. Channel 140 may be pre-formed in member 135, or may be cut from the members in a separate processing step. The lower portion of member 135 may be provided with a fillet section 145. Fillet section 45 provides a wider base to improve the stability of bed frame structure 92 when installed upon platform 100. Suitable wood screws may be installed through fillet section 145 to removably secure bed frame structure 92 to platform 100.

Figure 8A:
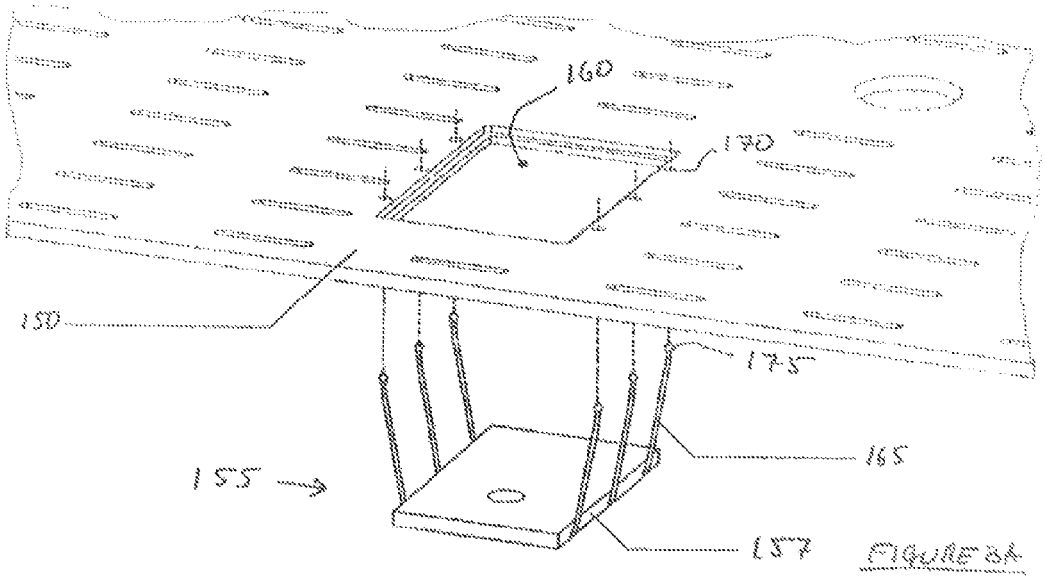
FIGS. 8A and 8B are isometric views of a compressor attachment according to a further embodiment of the present invention.
Figure 8B:
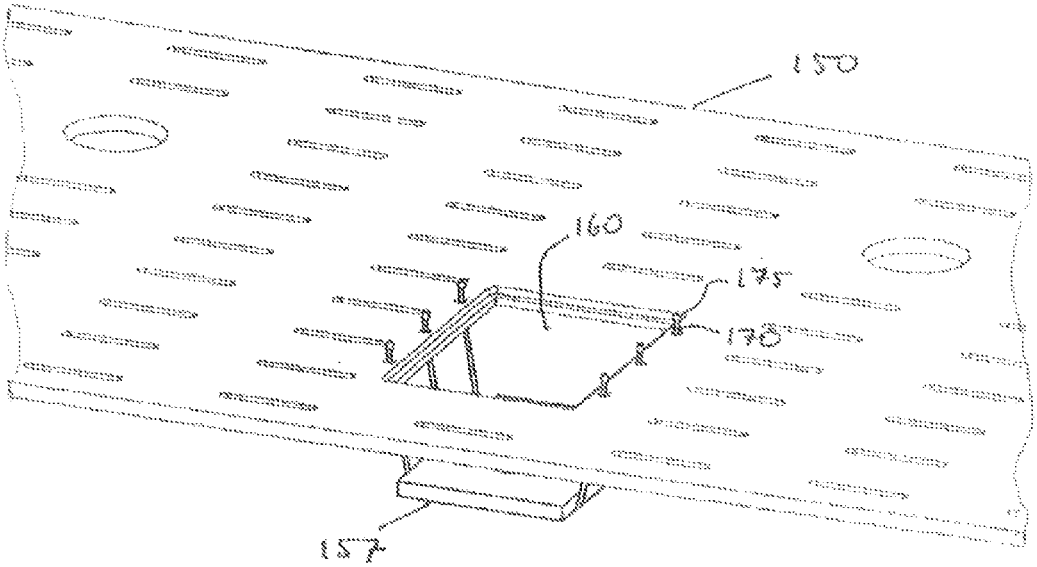
Figure 9:
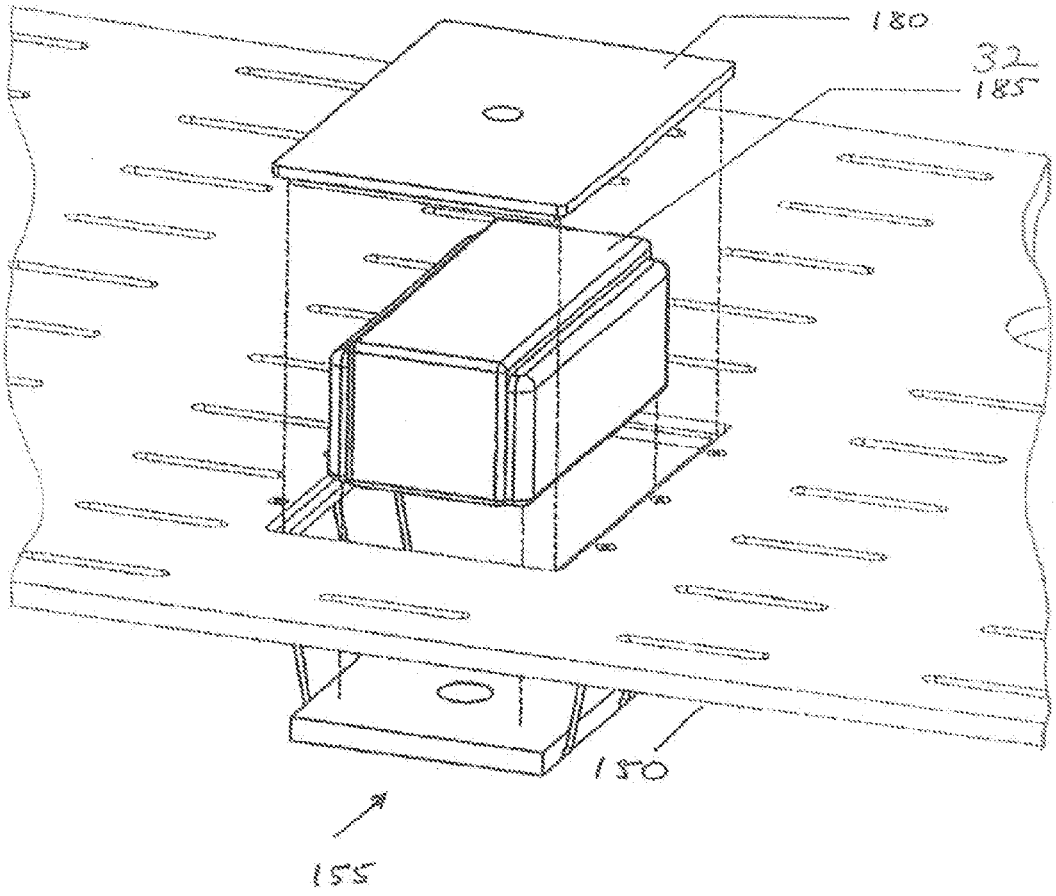
FIG. 9 is an isometric view of the compressor attachment according to a further embodiment of the present invention.

FIGS. 8A, 8B, and 9 show a further embodiment of platform 150 which includes an aperture 160. A base support 155 is suspended below aperture 160. The base support 155 includes connecting legs 165 with press fit elements 175 at the distal end of the legs 165. The press fit element 175 fit into recesses 170 on the platform 150. When installed as shown in FIG. 8B, base support 155 can act as a shelf 157 upon which articles can be placed whilst connected to the mattress assembly.

For instance as shown in FIG. 9, the support assembly 155 is used to support the compressor 32, which maintains and varies pressure in the air spring according to a further embodiment of the present invention. Aperture 160 may be cut with a recessed forming a lip that supports a closing panel 180. When installed, base support 155 lies flush with the upper surface of platform 100 to provide a consistent support across its surface for the mattress components.

Figure 10:
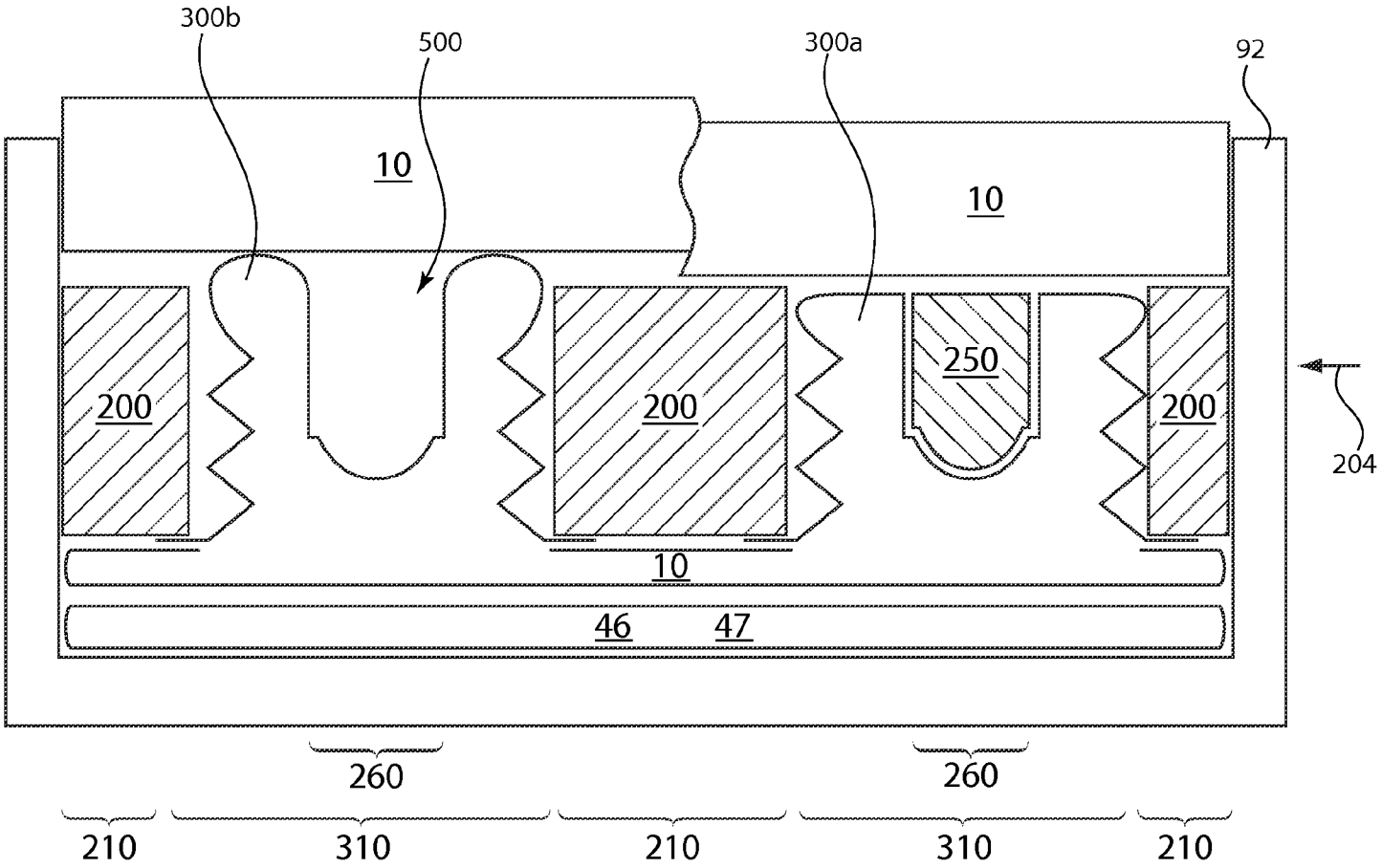
FIG. 10 is a cross-sectional view of the air springs showing multiple density components residing within one plane.

A cross-sectional view of the completed mattress assembly is shown in FIG. 10. The platform 100 and frame 92 provides a rigid support on the bottom and sides for the mattress components. The optional lower foam layer 47 and lower cover 46 are shown directly placed onto platform 100. Compressor provides pressurized air to bladder 30 which communicates with air springs 300*a* and 300*b*. Two air springs are shown for the sake of clarity, however, an actual mattress will have a plurality of air springs arranged in multiple columns and rows. The EVA foam layer 200 is shown in cross-section, cut across two of the apertures, with the air springs currently occupying those apertures. When viewing across the plane 202, the mattress assembly includes fixed density components in range 210. In planes of foam layer 200 that are in between the air-spring receiving apertures (not shown), the mattress comprises a fixed density component 210 contained on opposite sides thereof by a rigid frame 92.

In planes of foam layer 200 that include the apertures, like plane 204, fixed density components 210 alternate with variable density components in range 310. These alternating sections are labeled across the bottom of FIG. 10. If there are 8 air springs across, then 9 fixed density components 210 would alternate with 8 variable density components 310. Air spring 300*a* is shown with a moderate amount of air pressure, analogous to the air bladder shown in FIG. 2A. At low pressure levels a slight gap may be formed between the top of air spring 300*a* and the bottom of upper mattress portion 10. Air spring 300*a* may be further pressurized thereby increasing its height, for example where it is raised to the height of the top of foam layer 200. As pressure increases, air spring 300*a* will gradually contact upper mattress portion 10 and subsequently begin to exert upward pressure thereagainst.

At high pressure the top portion of air spring 300*b* will begin to form a donut shape, analogous to the air spring shown in FIG. 2B. As can be seen in the left hand portion of FIG. 10, upper mattress portion is raised slightly off of foam layer 200. The air springs are restricted from expanding laterally or expanding radially outwardly due to their accordion or bellows shaped side walls. These bellows-shaped, outer side walls are formed in a corrugated cylindrical shape. Cylindrical expanding bodies formed from non-expandable material will typically resist increasing in diametrical size, since the air pressure exerted in an outwardly direction is equal in all radial directions. However, when substantial body weight is placed on the mattress, some lateral expansion may occur. To guard against this expansion, the air springs 300*a* and 300*b* are surrounded by foam layer 200 which is contained within rigid frame 92. Air springs 300*a* and 300*b* are collectively referred to as air springs 300.

The cavity 500 inside each air spring 300*b* may be filled with a foam bullet 250 to further adjust the softness or firmness of the mattress at varying pressure levels. The foam bullet 250 provides a further region 260 of fixed density, referred to as a second fixed density component. Foam bullet 250 may be made from the same material as foam layer 200. If using the same material, the density of foam bullet 250 may be greater or less than the density of foam layer 200. Alternatively, foam bullet 250 may be made from a different material than foam layer 200. The second fixed density component 260 (foam bullet 250) is completed encircled by the variable density component 310 (air spring 300*a*). The variable density component 310 is completely encircled by the first fixed density component 210 (foam layer 200). The first, second and third density components are contained within the same plane 204.

Accordingly, the mattress assembly includes a first fixed density components 210, alternating with variable density components 310 and optional second fixed density component 260, all contained within a fixed frame. The fixed frame comprises a rigid reinforcing bar surrounded by a polymer. The variable density components comprise air springs, which can be selectively inflated to provide a frusto-toroidal contact area which exerts upward pressure on the upper mattress portion. The frusto-toroidal, or donut shaped contact area, allows the upper mattress portion to float above the first fixed density component. The frusto-toroidal contact area provides a more evenly distributed upward force, than a circular contact area that would be present if the air spring was a solid cylinder. In other words, the donut contact area provides an equivalent upward force with reduced contact area, making the mattress feel softer. The variable density components being cup-shaped can further contain a second fixed density component inside.

Having described preferred materials, configurations and methods (which are intended to be illustrative and non-limiting) it is noted that modifications and variations can be made by persons skilled in the art in light of the above teachings. This specification provides an exemplary listing of materials and mechanical properties that can be utilized to construct a mattress assembly. Other materials having the same mechanical properties may be used in connection with the invention to achieve similar results. It is therefore to be understood that changes may be made in particular embodiments of the invention disclosed which are within the scope and spirit of the invention as defined by the claims. Having thus described the invention with the details and particularity required by the patent laws, what is claimed and desired to be protected by Letters Patent is set forth in the appended claims.

What is claimed is:

1. A mattress assembly comprising:

a rigid frame and an upper mattress portion;

an array of air springs, each in communication with a supply of air, for selectively varying the air pressure within said spring, so as to provide a resilient body against which a user may recline, wherein each air spring includes (i) an outer cylindrical surface formed with accordion folds that substantially restricts the air spring from outward radial expansion when subject to increased internal pressure and (ii) an aperture in an upper surface of each air spring, providing access to a cavity within said spring, said cavity open to ambient pressure and sealed from the air supply;

a foam layer having a plurality of through cut-outs in registration with said air springs;

wherein the array of air spring are disposed within said frame with said foam layer being placed on top of said array with each air spring occupying a corresponding through cut-out; wherein each air spring has a top surface surrounding the aperture, upon inflation the top surface forms a frusto-toroidal shaped contact area for exerting upward pressure on said upper mattress portion; and a foam bullet disposed within the aperture of said air spring, wherein the foam layer comprises a first fixed density component, with said air spring comprising a variable density component, and said foam bullet comprising a second fixed density component; wherein said first, second and third density components all reside within the same plane.

2. The mattress assembly according to claim 1, wherein said cavity is arranged to contain a liquid or gel.

3. The mattress assembly according to claim 2, wherein said liquid or gel is aromatic.

4. The mattress assembly according to claim 1, wherein the cavity is arranged to contain a magnetic material.

5. The mattress assembly according to claim 1, wherein the cavity is arranged to receive an insert of a material softer than the air spring, the cumulative effect of said inserts within the array of air springs increasing the relative softness of the mattress.

6. The mattress assembly according to claim 1, wherein said foam layer is made from a material having a density in the range of about 40 to about 70 kg/m$^3$ and a Tensile Strength in the range of about 450 to about 800 kPa and a Tear Strength in the range of about 2.5 to about 4.5 kN/m and an Elongation at Break of about 200 to about 300% and a Compressive Strength of about 30 to about 60 kPa.

7. The mattress assembly according to claim 1, wherein said upper mattress portion includes:

a layer selected from the group consisting of a material having a density in the range of about 22 to about 80 kg/m$^3$; and a polyurethane foam layer made from a material having a density in the range of about 22 to about 70 kg/m$^3$.

* * * * *